US010991507B2

(12) United States Patent
Idogawa

(10) Patent No.: US 10,991,507 B2
(45) Date of Patent: Apr. 27, 2021

(54) IGNITION COIL FOR INTERNAL COMBUSTION ENGINE

(71) Applicant: Mitsubishi Electric Corporation, Tokyo (JP)

(72) Inventor: Takashi Idogawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/548,465

(22) PCT Filed: Apr. 15, 2015

(86) PCT No.: PCT/JP2015/061611
§ 371 (c)(1),
(2) Date: Aug. 3, 2017

(87) PCT Pub. No.: WO2016/166850
PCT Pub. Date: Oct. 20, 2016

(65) Prior Publication Data

US 2018/0025835 A1 Jan. 25, 2018

(51) Int. Cl.
*H01F 27/30* (2006.01)
*H01F 38/12* (2006.01)

(52) U.S. Cl.
CPC ..... *H01F 38/12* (2013.01); *H01F 2038/127* (2013.01)

(58) Field of Classification Search
CPC ..... H01F 2038/127
USPC ..... 336/208
See application file for complete search history.

(56) References Cited

U.S. PATENT DOCUMENTS

2005/0134417 A1 6/2005 Maekawa et al.
2011/0239999 A1* 10/2011 Steinberger ..... H01F 38/12 123/634
2012/0299679 A1 11/2012 Kobayashi et al.

FOREIGN PATENT DOCUMENTS

CN 102800470 A 11/2012
JP 6-020853 A 1/1994
JP 7-263256 A 10/1995
JP 7-320960 A 12/1995
JP 2734540 B2 3/1998
JP 2001-210534 A 8/2001
JP 2005-183516 A 7/2005
(Continued)

OTHER PUBLICATIONS

International Search Report of PCT/JP2015/061611, dated Jul. 7, 2015. [PCT/ISA/210].
(Continued)

*Primary Examiner* — Ronald Hinson
(74) *Attorney, Agent, or Firm* — Sughrue Mion, PLLC; Richard C. Turner

(57) ABSTRACT

An ignition coil for an internal combustion engine includes: a center core arranged on an inner side of a primary coil and an inner side of a secondary coil; a side core arranged on an outer side of the primary coil and an outer side of the secondary coil, and combined with the center core to form a closed magnetic circuit; one or a plurality of gaps provided between the center core and the side core, or in the side core; and a magnet arranged in each of the one or a plurality of gaps, in which a sum of cross-sectional areas of the respective magnets is set to be three times or more and less than seven times of a cross-sectional area of the center core.

18 Claims, 9 Drawing Sheets

(56) References Cited

FOREIGN PATENT DOCUMENTS

| | | | |
|---|---|---|---|
| JP | 2007-103482 | A | 4/2007 |
| JP | 2008-294192 | A | 12/2008 |
| JP | 2009-124015 | A | 6/2009 |

OTHER PUBLICATIONS

Communication dated Oct. 9, 2019 from the State Intellectual Property Office of the P.R.C. in application No. 201580078573.9.

* cited by examiner

IGNITION COIL FOR INTERNAL COMBUSTION ENGINE

CROSS REFERENCE TO RELATED APPLICATIONS

This application is a National Stage of International Application No. PCT/JP2015/061611 filed Apr. 15, 2015, the contents of all of which are incorporated herein by reference in their entirety.

TECHNICAL FIELD

The present invention relates to an ignition coil for an internal combustion engine that is installed on an internal combustion engine for, for example, a motor vehicle, and is configured to supply a high voltage to an ignition plug, thereby generating spark discharge.

BACKGROUND ART

Hitherto, various means have been taken for the ignition coil for an internal combustion engine in order to increase efficiency and the amount of a generated voltage (see, for example, Patent Literatures 1 and 2).

However, hitherto, the ignition coil for an internal combustion engine is designed in consideration only of a peak performance of the ignition coil.

CITATION LIST

Patent Literature

[PTL 1] JP 2734540 B2 (magnetic circuit)
[PTL 2] JP 2007-103482 A (magnetic resistance)

SUMMARY OF INVENTION

Technical Problem

In recent years, a compression ratio has been increased, and a downsizing turbo vehicle has been developed in order to increase engine combustion efficiency in the context of a demand for improvement in fuel consumption. Accordingly, increases in voltage and output of the ignition coil are demanded in order to carry out secure dielectric breakdown and combustion under a high compression condition.

In some of such vehicles, a compression ratio is set to be high in a high rpm region or also in a low voltage region, and an ignition coil configured to provide high output from the low voltage region to the high rpm region is thus required.

In a related-art ignition coil, there has been used such a method that a center core cross-sectional area is increased in order to increase energy, and a wire diameter of a primary coil (a wire diameter of a winding of the primary coil) is increased to decrease its resistance, thereby increasing energy in the high rpm region or also in the low voltage region.

However, even in the case where the above-mentioned method is used, the core cross-sectional area and the wire diameter of the primary coil and the like need to greatly increase in order to improve a high rpm characteristic.

The present invention has been made in view of the above-mentioned problem, and therefore has an object to provide an ignition coil for an internal combustion engine capable of providing high output even in a high rpm region for suppressing an increase in size.

Solution to Problem

According to one embodiment of the present invention, there is provided an ignition coil for an internal combustion engine, including: a center core arranged on an inner side of a primary coil and an inner side of a secondary coil; a side core arranged on an outer side of the primary coil and an outer side of the secondary coil, and combined with the center core to form a closed magnetic circuit; one or a plurality of gaps provided between the center core and the side core, or in the side core; and a magnet arranged in each of the one or a plurality of gaps, in which a sum of cross-sectional areas of the respective magnets is set to be three times or more and less than seven times of a cross-sectional area of the center core.

Advantageous Effects of Invention

According to the present invention, it is possible to provide the ignition coil for an internal combustion engine capable of providing the high output even in the high rpm region for suppressing the increase in size.

DESCRIPTION OF EMBODIMENTS

Now, an ignition coil for an internal combustion engine according to each of embodiments of the present invention is described with reference to the drawings. Note that, in each of the embodiments, the same or corresponding portions are denoted by the same reference symbols, and the overlapping description thereof is omitted.

First, a detailed description is given of a principle and effects of the present invention.

Figure 13:
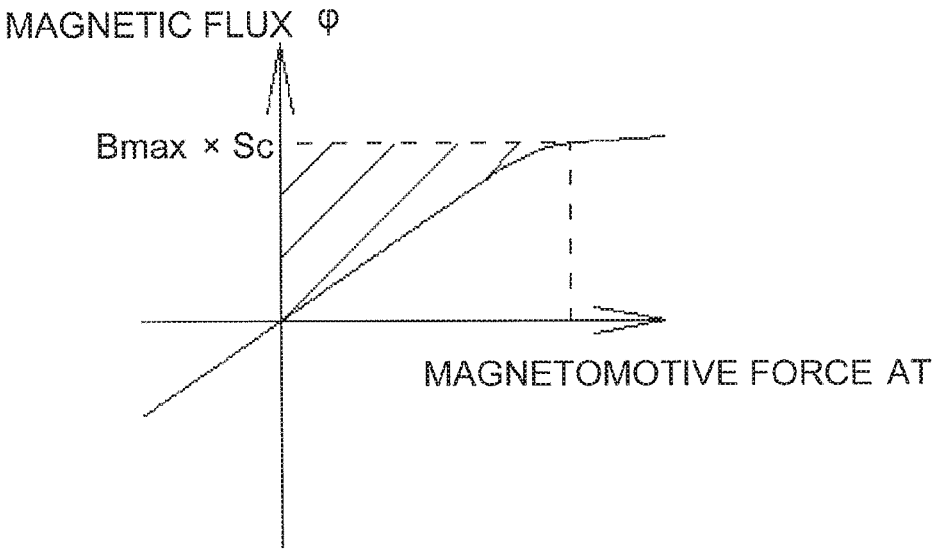
FIG. 13 is a magnetic characteristic diagram for showing a basic magnetic characteristic of an ignition coil without a magnet.
Figure 14:
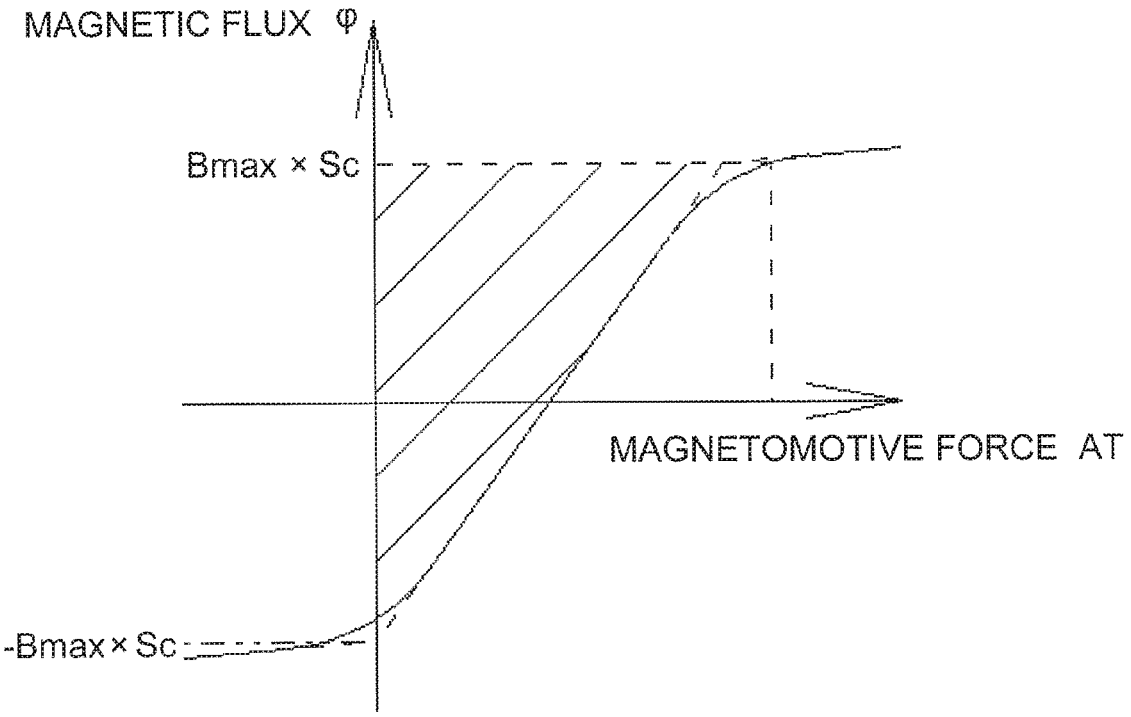
FIG. 14 is a magnetic characteristic diagram for showing a basic magnetic characteristic of an ignition coil with a magnet.

FIG. 13 and FIG. 14 are magnetic characteristic diagrams for showing a basic magnetic characteristic (magnetic flux-magnetomotive force characteristic) of an ignition coil. Energy of the ignition coil is proportional to an area of a hatched portion of each of FIG. 13 and FIG. 14.

Magnetic flux of a core used for the ignition coil saturates and magnetically saturates at a value of a product of a saturation magnetic flux density Bmax determined specifically by a material and a center core cross-sectional area Sc.

In some of the ignition coils for an internal combustion engine of this type as the ignition coil for an internal combustion engine according to the present invention, which is exemplified in FIG. 1 referred to later, a magnet 70 is inserted into a gap 60 of a center core 30 out of the center core 30 and a side core 40 forming a closed magnetic circuit. FIG. 13 is a diagram for showing a magnetic characteristic of an ignition coil without a magnet. FIG. 14 is a diagram for showing a magnetic characteristic of an ignition coil provided with a magnet.

Hitherto, in the ignition coil of this type, the magnet is inserted to increase energy at the center core for the same cross-sectional area. A reverse bias is applied in a center core negative direction, and a magnetic resistance and a magnet size are adjusted so that the reverse bias is close to a negative direction magnetic saturation. Then, magnetic flux is injected by a primary coil until magnetic saturation occurs in a positive direction, that is, a magnetomotive force is applied. In this way, output is increased while an increase in size of the center core is prevented.

On the other hand, in a high rpm region, a current supply period Ton for the primary coil satisfying Expressions (1) and (2) is set at each rpm so that performance may correspond to a magnetomotive force during the current supply period Ton.

$$\alpha c \geq \int_0^{Ton} (Vc \times I1)\,dt \quad (1)$$

$$\alpha d \geq \int_0^{Ton} (Vce \times I1)\,dt \quad (2)$$

On this occasion, I1 denotes a current flowing on an ignition coil primary side (the primary coil and a coil driver), and is approximated as follows.

$$I1 = V1/R1\{1-\exp\{-(R1/L1)\times \mathrm{Ton}\}] \quad (3)$$

Expressions (1) to (3) are based on the following.

αc: electric energy prescribed value of primary coil

αd: electric energy prescribed value of coil driver

Vc: voltage between both ends of primary coil

Vce: voltage between both ends of coil driver (igniter=switching element)

V1: voltage supplied to primary side

R1: combined resistance (primary coil resistance and harness resistance, and the like) connected to primary side L1: primary inductance The right side of Expression (1) represents a loss in the primary coil. The right side of Expression (2) represents a coil driver loss. Expressions (1) and (2) show that the current supply period Ton for the ignition coil needs to be changed so that these losses are equal to or less than the prescribed values in order to suppress heat generation.

In accordance with Expression (3), when Ton is decreased, I1 decreases. The magnetomotive force injected into the magnetic circuit is represented as a product of the primary current I1 and a primary number of turns n1, and the magnetomotive force thus decreases when Ton is decreased.

When an engine rpm characteristic is considered, the number of ignitions per unit period increases in proportion to the engine rpm, and the heat generation thus increases in proportion to the rpm in the high rpm region. Therefore, αc and αd decrease inversely proportional to the rpm. As αc and αd decrease, the current supply period Ton for the primary coil needs to be suppressed in the high rpm region. As described above, the primary current I1 decreases as the current supply period Ton decreases, and the magnetomotive force injected into the core decreases as a result. An injected magnetic flux amount (magnetomotive force) in the high rpm region changes in accordance with a primary resistance, and is approximately 600 AT to approximately 800 AT for the primary resistance of an ordinary ignition coil, which is approximately 0.3Ω to approximately 0.7Ω. Therefore, when an area given by the magnetic characteristic diagram with the magnetomotive force of 600 AT or more can be increased, the energy of the ignition coil can be increased in an rpm region for practical use.

The ignition coil needs to provide energy in accordance with an engine request (request for energy in accordance with rpm), and is required to have a specification for securing, for the request for each rpm, the area on the magnetic characteristic given by the magnetomotive force determined for each rpm.

Hitherto, the energy at the high rpm is increased by a method involving improving the magnetic characteristic by increasing the core cross-sectional area, and increasing the primary wire diameter, that is, the radius of the winding of the primary coil to suppress the power consumption, thereby increasing the minimum magnetomotive force. However, this method has the following problems for increasing the high rpm energy.

Increase in Core Cross-Sectional Area

Figure 15:
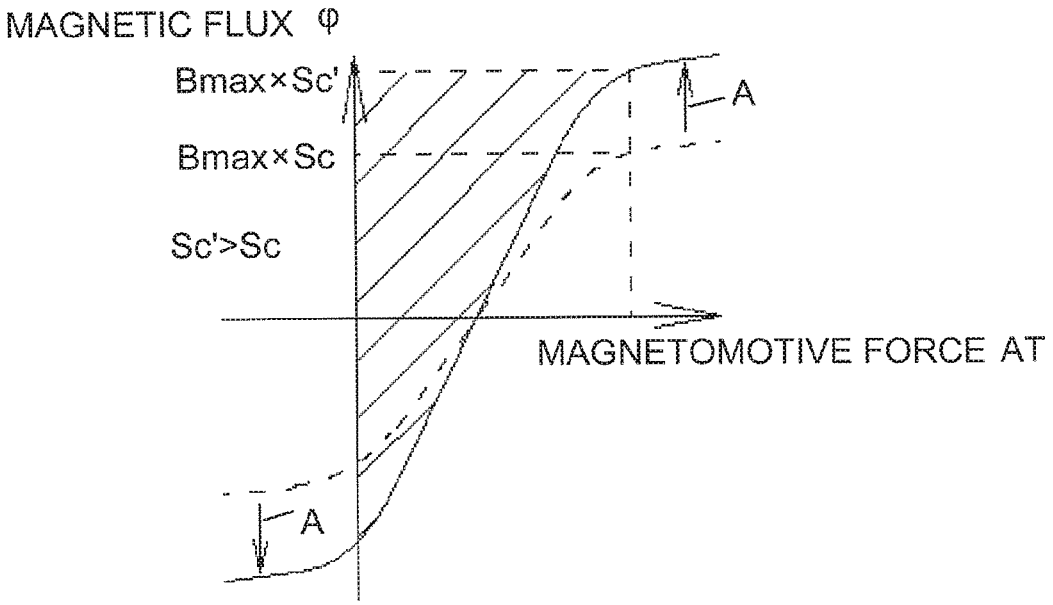
FIG. 15 is a magnetic characteristic diagram for showing a change in magnetic characteristic caused by an increase in core cross-sectional area.

As FIG. 15, the magnetic characteristic diagram changes by increasing the core cross-sectional area. The solid line represents such a characteristic that the center core cross-sectional area is increased with respect to the broken line, as indicated by an arrow A. As the center core cross-sectional area Sc increases, Bmax×Sc increases. On this occasion, it is assumed that cross-sectional area ratios of the side core, the magnet, and the core gap to the center core cross-sectional area are constant.

Figure 16:
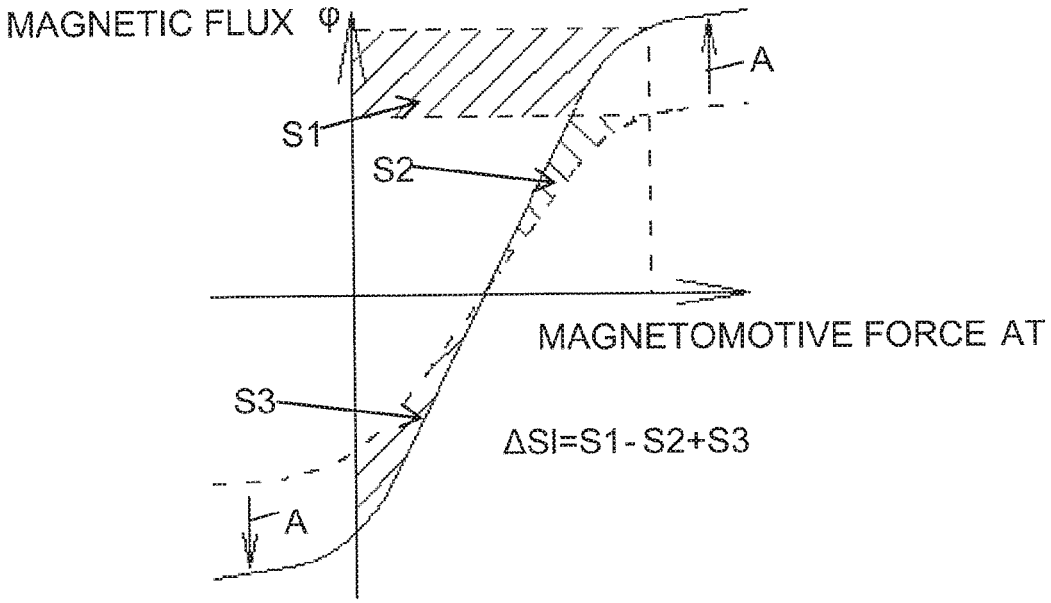
FIG. 16 is a magnetic characteristic diagram for showing an energy increase at a peak in a low rpm region.
Figure 17:
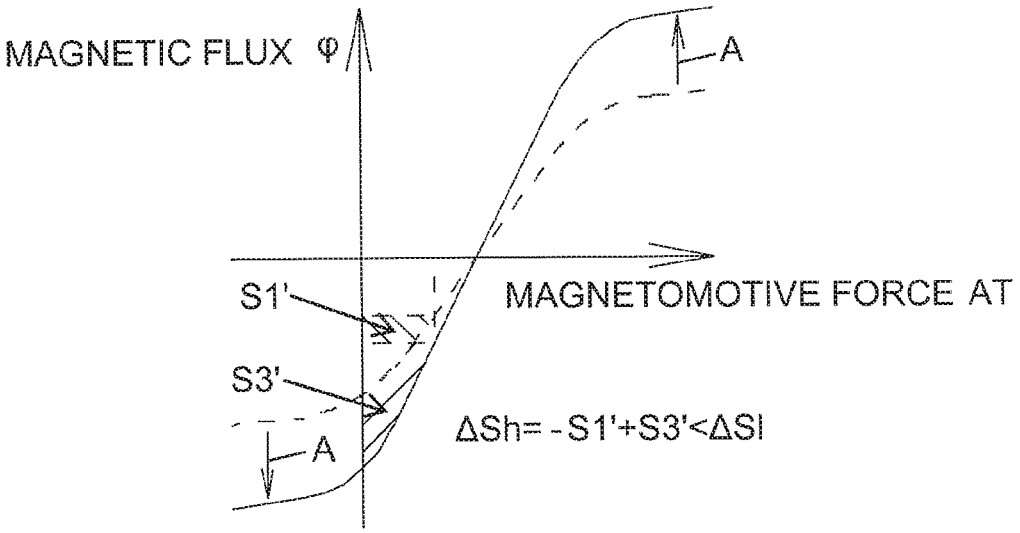
FIG. 17 is a magnetic characteristic diagram for showing an energy increase at a peak in a high rpm region.

In the low rpm region, as shown in FIG. 16, the peak energy, namely, the magnetomotive force can be used at the maximum, and thus increases in proportion to the center core cross-sectional area ($\Delta S1=S1-S2+S3$). In an area in which the injected magnetomotive force is small, as in the high rpm region shown in FIG. 17, the energy increase amount decreases as compared with the increase amount at the peak shown in FIG. 16 ($\Delta Sh=S1'+S3'<\Delta SI$). Therefore, in the high rpm region in which the injected magnetomotive force is small, the performance increase amount is limited.

Moreover, as the core cross-sectional area increases, the primary coil winding diameter, that is, the circumference of the primary coil wound around a bobbin by one turn increases, a total wire length of the primary coil increases, resulting in an increase in resistance value. The heat generation thus increases. In order to avoid the heat generation, a decrease in current supply period is necessary, and consequently, the injected magnetomotive force decreases in the high rpm region. As a result, the performance increase amount further decreases. Moreover, when the wire diameter is increased in order to compensate for the increase in wire length, the size of the coil increases.

Increase in Primary Wire Diameter

When the primary resistance decreases by the increase in primary wire diameter, the voltage between both ends of the primary coil decreases, and the primary coil heat generation decreases. Therefore, when only the restriction imposed by Expression (1) is considered, the current supply period Ton for the primary coil can be increased, and as a result, the injected magnetic flux can be increased.

On the other hand, regarding Expression (2), a current supply period required for obtaining the same magnetomotive force (=breaking current) decreases due to the decrease in primary resistance in accordance with Expression (3). Therefore, the heat generation decreases more or less, and the current supply period can be increased, thereby increasing the injected magnetomotive force to the core. The current supply period decrease amount is small when the primary resistance decreases, and the injected magnetic flux increase amount is thus small. Therefore, a great increase in wire diameter of the primary coil is required in order to improve the high rpm characteristic.

From the above, it is difficult to greatly improve the high rpm characteristic in the related-art design, and an increase in size is inevitable for the improvement.

First Embodiment

A description is now given of a specific example of the ignition coil for an internal combustion engine according to the first embodiment of the present invention.

Figure 1:
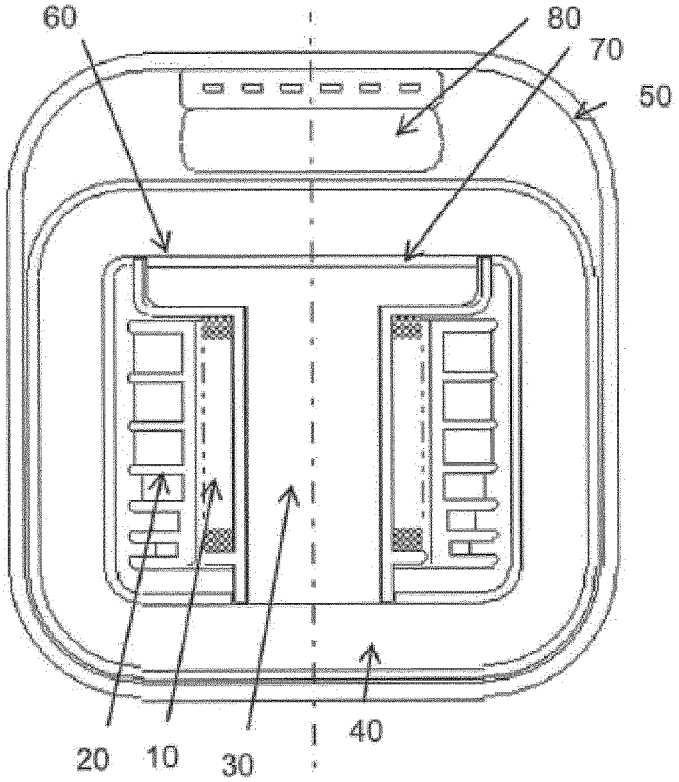
FIG. 1 is a schematic view for illustrating an ignition coil for an internal combustion engine according to a first embodiment of the present invention as viewed from above.

FIG. 1 is a schematic view for illustrating the ignition coil for an internal combustion engine according to the first embodiment of the present invention as viewed from above. As illustrated in FIG. 1, the ignition coil for an internal combustion engine according to the first embodiment includes a primary coil 10, a secondary coil 20, the center core 30 arranged on the inner side of the primary coil 10 so as to magnetically couple the primary coil 10 and the secondary coil 20 to each other, the side core 40 combined with the center core 30 so as to form the closed magnetic circuit, a coil driver (igniter) 80 configured to perform control of applying current supply or interrupting the current supply to the primary coil 10 in accordance with a drive signal from an ECU (not shown) or the like, and an insulation case 50 configured to accommodate these respective components. One end of the side core 40 abuts against one end of the center core 30. Another end of the side core 40 faces another end of the center core 30 across a gap 60. A magnet 70 having the same size as the gap 60 is inserted into the gap 60.

In more detail, the primary coil 10 and the secondary coil 20, which is wound on the outer side of the primary coil 10, are wound around the center core 30. For the sake of easy understanding of the structure, the primary coil 10 and the secondary coil 20 on a top surface portion of the center core 30 are omitted for the illustration. The side core 40 has an annular shape extending over one complete turn around the center core 30 around which the primary coil 10 and the secondary coil 20 are wound. The one end of the center core 30 abuts against a surface serving as the one inner end of the side core 40. The another end of the center core 30 has such a shape that its cross-sectional area on a plane orthogonal to a magnetic flux direction inside the center core 30 increases, and faces a surface serving as the another inner end facing the above-mentioned one end of the side core 40 across the gap 60. The magnet 70 having the same size as the gap 60 is inserted into the gap 60.

Figure 2:
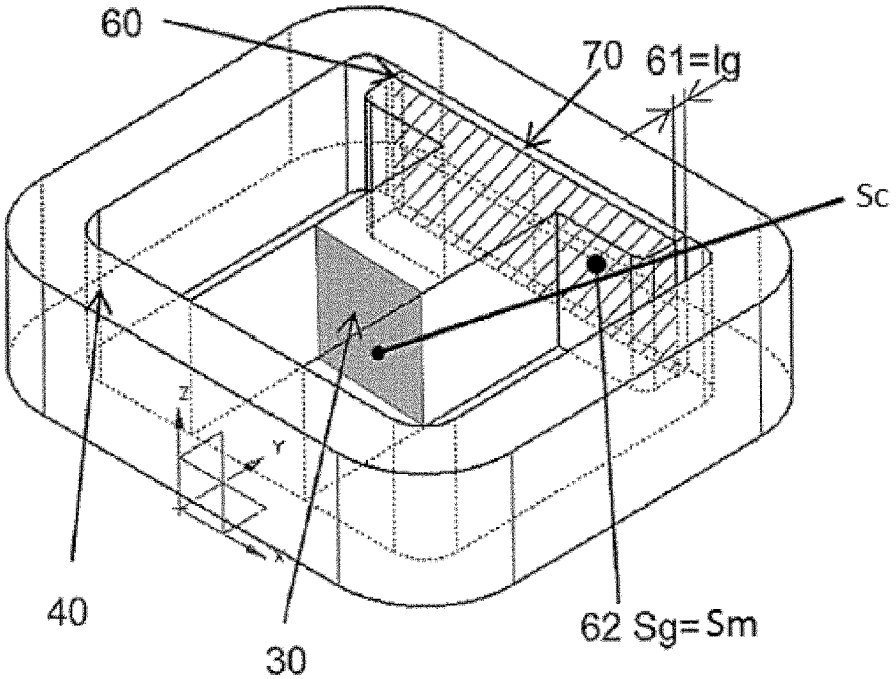
FIG. 2 is a schematic perspective view for illustrating the ignition coil for an internal combustion engine of FIG. 1 as viewed from obliquely below.

FIG. 2 is a schematic perspective view (magnetic circuit diagram) for illustrating the ignition coil for an internal combustion engine of FIG. 1 without the primary coil 10 and the secondary coil 20 as viewed from obliquely below with respect to the direction of FIG. 1.

The O-shaped side core is used in the above-mentioned example, but a C-shaped core may be used.

Figure 3:
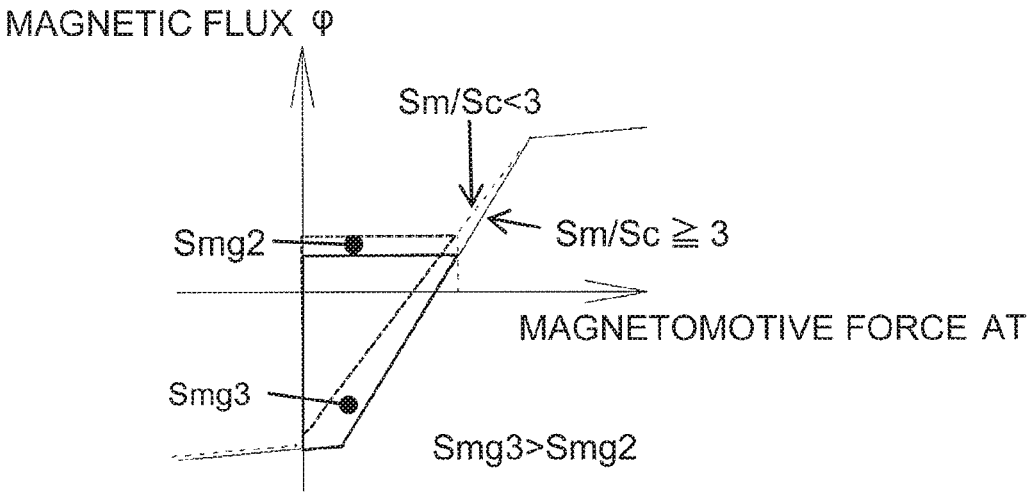
FIG. 3 is a magnetic characteristic diagram for showing an action of the ignition coil for an internal combustion engine according to the first embodiment of the present invention.

In an invention according to a first embodiment of the present invention, the cross-sectional area Sm of the magnet 70 is set to be equal to or more than three times of the cross-sectional area Sc of the center core 30. Moreover, the cross-sectional area Sg of the gap 60 is set to be equal to or larger than the cross-sectional area Sm of the magnet 70, that is, set as $Sm \leq Sg$. As a result, a sufficient reverse bias can be applied. FIG. 3 is a magnetic characteristic diagram for showing a comparison between a case where $Sm/Sc \geq 3$ (solid line) and a case where $Sm/Sc<3$ (broken line). From FIG. 3, the magnetic flux saturation point in the negative region of the magnetic characteristic is shifted toward the high magnetomotive force side in the region where the magnetomotive force AT is positive by increasing the cross-sectional area Sm of the magnet ($Sm/Sc \geq 3$). As a result, the area increases in the low magnetomotive force region, and the performance can thus be improved. Moreover, in a similar manner, the energy (area) in the high magnetomotive force region can be increased without increasing the size of the center core 30. The energy in the high rpm region also increases, and the center core 30 can be downsized in accordance with a required performance in the low rpm region.

When the number of each of the gap 60 and the magnet 70 is one, the cross-sectional area Sm of the magnet is set to be three times or more of the cross-sectional area Sc of the center core 30. When the number of the gaps 60 and the magnets 70 is two or more, the sum Sm of the cross-sectional areas of the magnets is set to be three times or more of the cross-sectional area Sc of the center core 30.

Figure 18:
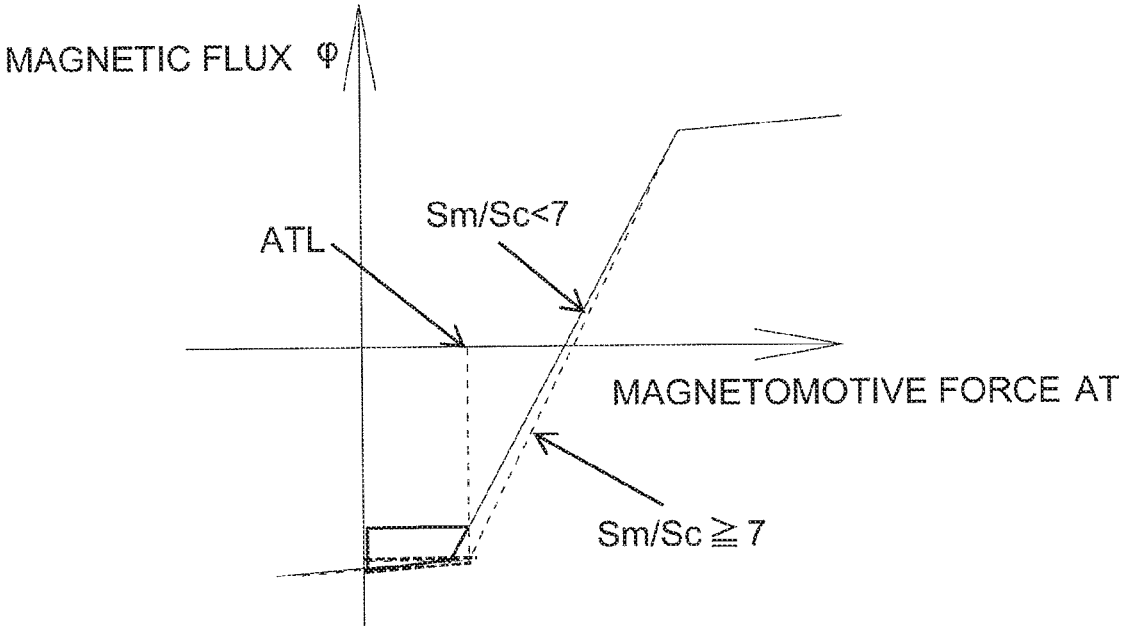
FIG. 18 is a magnetic characteristic diagram for showing the action of the ignition coil for an internal combustion engine according to the first embodiment of the present invention.

Further, while the lower limit of the sum Sm of the cross-sectional areas of the magnets is set as described above, the upper limit of the sum Sm of the cross-sectional areas of the magnets is set to be less than seven times of the cross-sectional area Sc of the center core 30 ($Sm/Sc<7$). When the sum Sm is equal to or more than seven times (Sm/Sc≥7), as represented by the broken line of FIG. 18, a bent position of the magnetic characteristic curve appears after the minimum magnetomotive force ATL, and the energy in a neighborhood of the minimum magnetomotive force greatly decreases. Therefore, the upper limit value is set to Sm/Sc<7 represented by the solid line.

According to the present invention, the cross-sectional area (Sg) of the gap and the cross-sectional area (Sm) of the magnet are respectively cross-sectional areas on planes orthogonal to respective thickness directions. Cross-sectional areas (Sc and Ss) of the center core and the side core are cross-sectional areas on planes each orthogonal to a longitudinal direction of the core or the magnetic flux direction in the core (the same holds true hereinafter).

Second Embodiment

Figure 4:
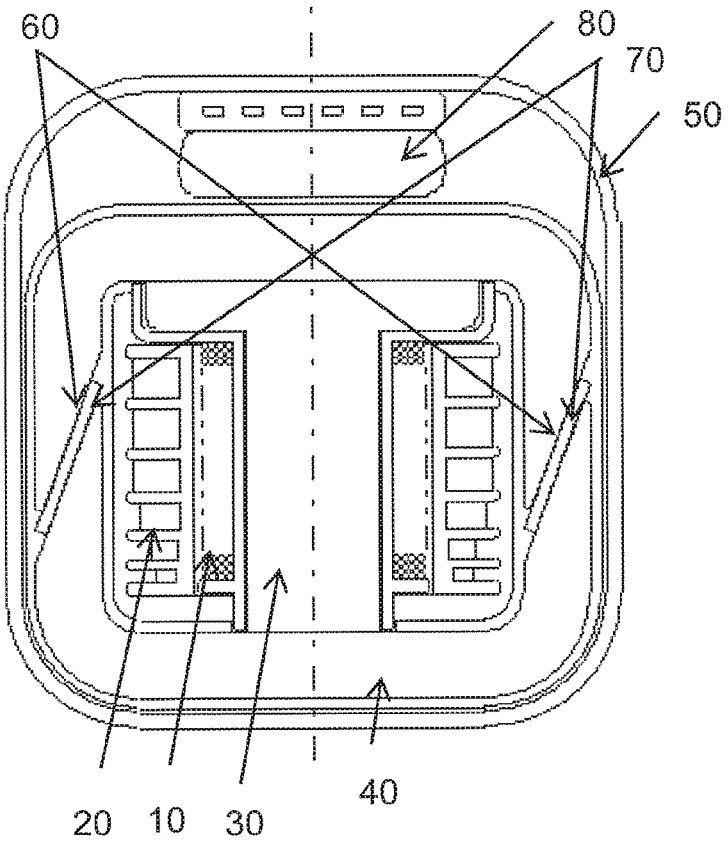
FIG. 4 is a schematic view for illustrating an ignition coil for an internal combustion engine according to a second embodiment of the present invention as viewed from above.
Figure 5:
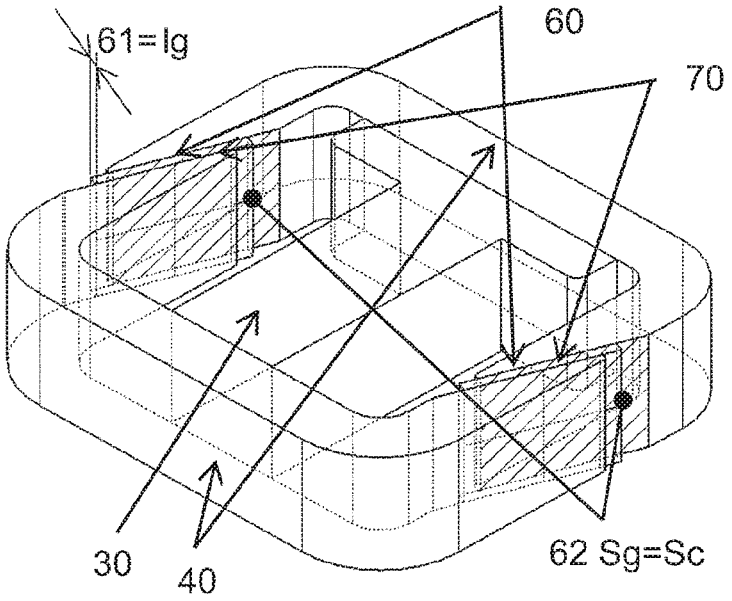
FIG. 5 is a schematic perspective view for illustrating the ignition coil for an internal combustion engine of FIG. 4 as viewed from obliquely below.

FIG. 4 is a schematic view for illustrating an ignition coil for an internal combustion engine according to a second embodiment of the present invention as viewed from above. FIG. 5 is a schematic perspective view (magnetic circuit diagram) for illustrating the ignition coil for an internal combustion engine of FIG. 4 without the primary coil 10 and the secondary coil 20 as viewed from obliquely below with respect to the direction of FIG. 4. According to the second embodiment, as illustrated in FIG. 4, the gaps 60 and the magnets 70 are arranged in the side core 40. Further, the gap 60 and the magnet 70 may be arranged to incline as illustrated. Other configurations are the same as those of the first embodiment.

In the ignition coil configured in this way, the gaps 60 and the magnets 70 are arranged in the side core 40. Thus, even in a case of such a coil specification that the numbers of turns of the primary coil 10 and the secondary coil 20 are small, a case where a space for increasing the cross-sectional area of the tip of the center core 30 does not exist, or the like, the cross-sectional area 62 (Sg) of the gaps 60 and the cross-sectional area (Sm) of the magnets 70 can be secured. Thus, the magnetic characteristic can easily be adjusted. Moreover, the magnetic characteristic to be secured can be adjusted in the side core 40, and hence the center core 30, the primary coil 10, and the secondary core 20 can thus be common components.

Third Embodiment

Figure 6:
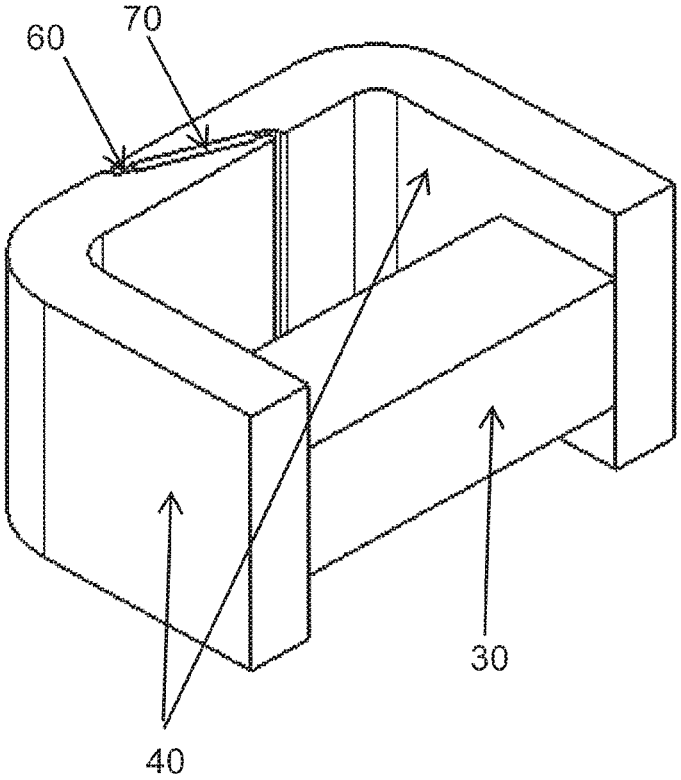
FIG. 6 is a schematic view for illustrating an ignition coil for an internal combustion engine according to a third embodiment of the present invention.
Figure 7:
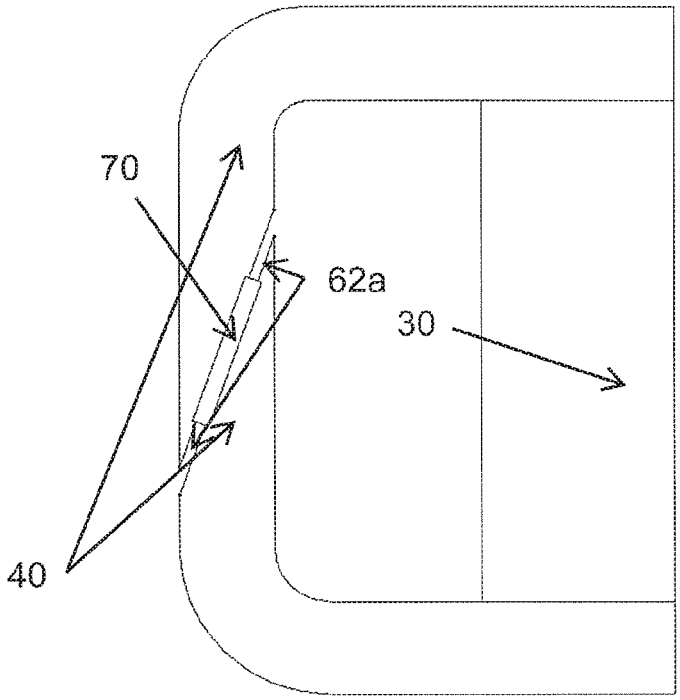
FIG. 7 is a schematic top view for illustrating the ignition coil for an internal combustion engine of FIG. 6.

FIG. 6 is a schematic perspective view for illustrating an ignition coil for an internal combustion engine according to a third embodiment of the present invention. FIG. 7 is a schematic top view (magnetic circuit diagram) for illustrating the ignition coil for an internal combustion engine of FIG. 6. According to the third embodiment, as illustrated in FIG. 6, a loading thickness of the side core 40 is increased and the width thereof is decreased. Moreover, the cross-sectional area (Sm) of the magnet 70 is decreased as compared with the cross-sectional area 62 (Sg) of the gap 60. In other words, the cross-sectional area (Sg) of the gap 60 is increased with respect to the cross-sectional area (Sm) of the magnet 70. Further, a thickness 62*a* of the gap 60 at portions that do not abut against the magnet 70 is decreased, and a cross-sectional area (Ss) of the side core 40 is increased as compared with the cross-sectional area (Sc) of the center core 30.

Figure 8:
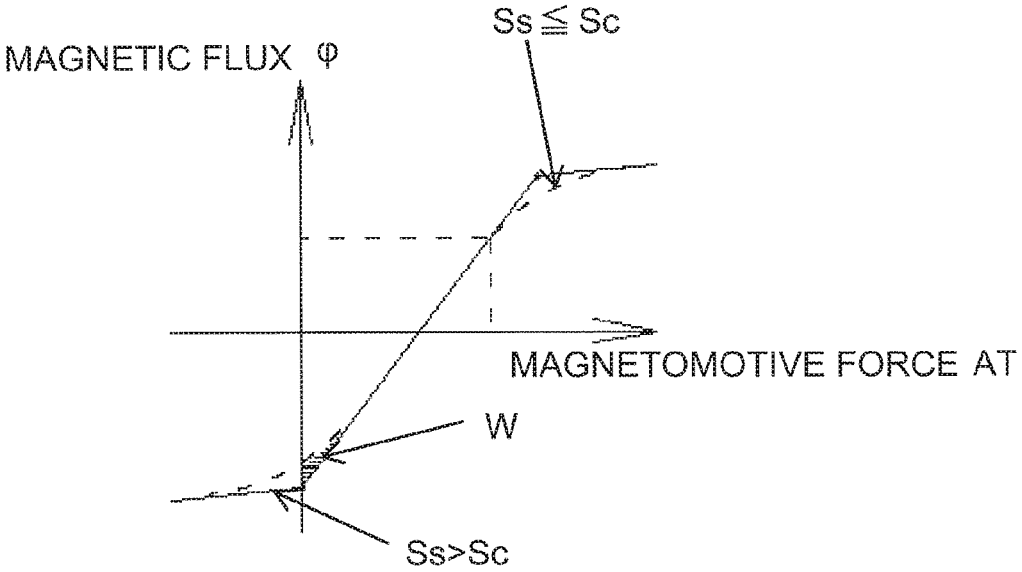
FIG. 8 is a magnetic characteristic diagram for showing an action of the ignition coil for an internal combustion engine according to the third embodiment of the present invention.

When the cross-sectional area (Ss) of the side core 40 is small as compared with the cross-sectional area (Sc) of the center core 30, the magnetic saturation of the side core 40 occurs before the magnetic saturation of the center core 30. Therefore, the magnetic resistance increases in the region where the side core 40 magnetically saturates, and the gradient of the magnetic characteristic decreases. Thus, a magnetic characteristic in the case where Sc≥Ss is the one as represented by the broken line of FIG. 8, and a magnetic characteristic in the case where Sc<Ss is the one as represented by the solid line of FIG. 8. When Sc≥Ss, the area decreases when the magnet reverse bias in a neighborhood of the magnetic characteristic negative-side saturation point is applied. Thus, the energy can be increased without the magnetic saturation of the side core 40 before the center core 30 magnetically saturates when the magnet reverse bias is applied by providing such a relationship of Sc<Ss. In FIG. 8, W indicates a performance improvement portion.

Moreover, the height of the side core 40 is increased, and the cross-sectional area can thus be increased in length in the loading thickness direction. As a result, the cross-sectional area can be decreased in length in the width direction, and the downsizing can thus be achieved. Moreover, the cross-sectional area Sm of the magnets 70 is decreased as compared with the cross-sectional area (Sg) 62 of the gaps 60, and the thickness 62*a* of the gap 60 at the portions that do not abut against the magnet 70 is decreased. Therefore, even when such a thickness of the magnet 70 that prevents a damage during the assembly is secured, an average thickness (average Ig) of the gaps can be decreased because the thickness 62*a* of the gap at the non-abutment portions against the magnet 70 is decreased. As a result, Sg/Ig can be increased even when Sg is decreased.

Fourth Embodiment

Figure 9:
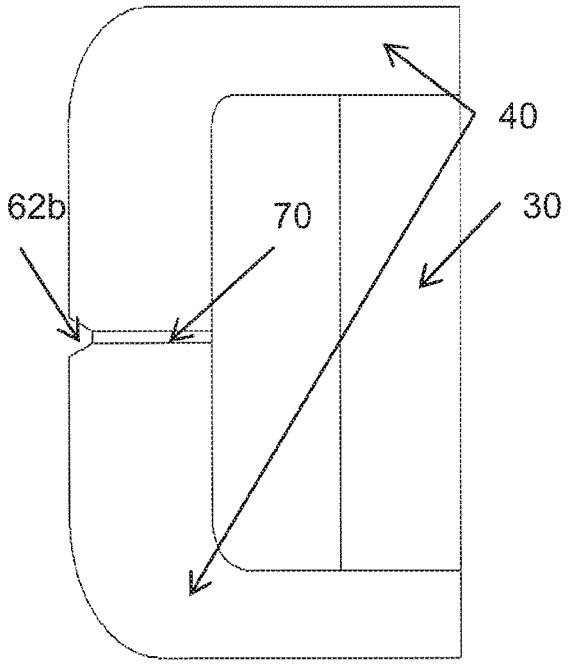
FIG. 9 is a schematic top view for illustrating an ignition coil for an internal combustion engine according to a fourth embodiment of the present invention.
Figure 10:
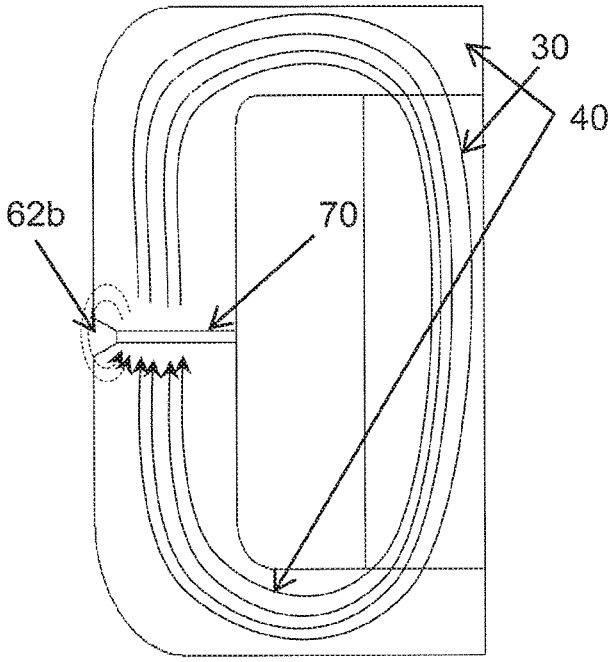
FIG. 10 is a diagram for illustrating magnetic flux from a magnet in the ignition coil for an internal combustion engine of FIG. 9.

FIG. 9 is a schematic top view (magnetic circuit diagram) for illustrating an ignition coil for an internal combustion engine according to a fourth embodiment of the present invention. FIG. 10 is a diagram (magnetic circuit diagram) for illustrating magnetic flux from a magnet in the ignition coil for an internal combustion engine of FIG. 9. According to the fourth embodiment, as illustrated in FIG. 9, the cross-sectional area Sm of the magnet 70 is decreased with respect to the cross-sectional area Sg of the gap 60, and the thickness 62*b* of the gap 60 is increased at the non-abutment portions against the magnet 70. Other configurations are the same as those of the third embodiment.

In the ignition coil configured as described above, the magnetic flux from the magnet 70 does not loop without crossing the center core 30, and the magnetic flux of the magnet 70 can efficiently be applied to the center core 30.

In the portion of the gap 60 having the large thickness 62*b*, the magnetic flux that does not cross the center core 30 is generated. However, a space distance is long, and hence the magnetic flux is less likely to pass through the space, and decreases.

The above-mentioned configuration may be applied also to a case where the gap 60 and the magnet 70 are provided in the center core 30.

Fifth Embodiment

Figure 11:
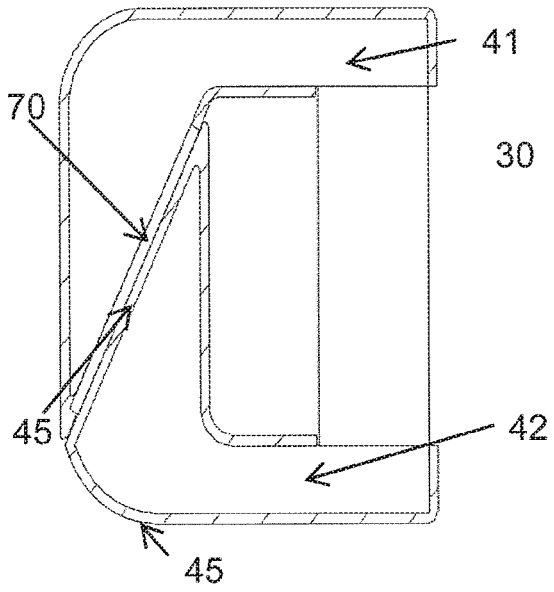
FIG. 11 is a schematic top view for illustrating an ignition coil for an internal combustion engine according to a fifth embodiment of the present invention.

FIG. 11 is a schematic top view (magnetic circuit diagram) for illustrating an ignition coil for an internal combustion engine according to a fifth embodiment of the present invention. According to the fifth embodiment, as illustrated in FIG. 11, side core covers 45, which are core cushions, are provided on side surfaces of side cores 41 and 42. One main surface of the magnet 70 abuts against the side core 41, and another main surface abuts against the side core 42 via the side core cover 45. Other configurations are the same as those of the second embodiment.

In the ignition coil configured in this way, the thickness (Ig) 61 of the air gap 60 can be stably secured without unnecessarily increasing the thickness of the magnet 70 and providing additional components. The above-mentioned example is configured so that the magnet 70 abuts against the side core 41, and the side core cover 45 is provided on the side core 42, thereby securing the thickness (Ig) 61 of the air gap. However, such a configuration that the magnet 70 abuts against the side core 42 side may be similarly provided without problem. Further, there poses no problem even when the gap 60 and the magnet 70 are arranged between the side core 41 or 42 and the center core 30 in such a configuration that the core cover is provided as described above.

Sixth Embodiment

Figure 12:
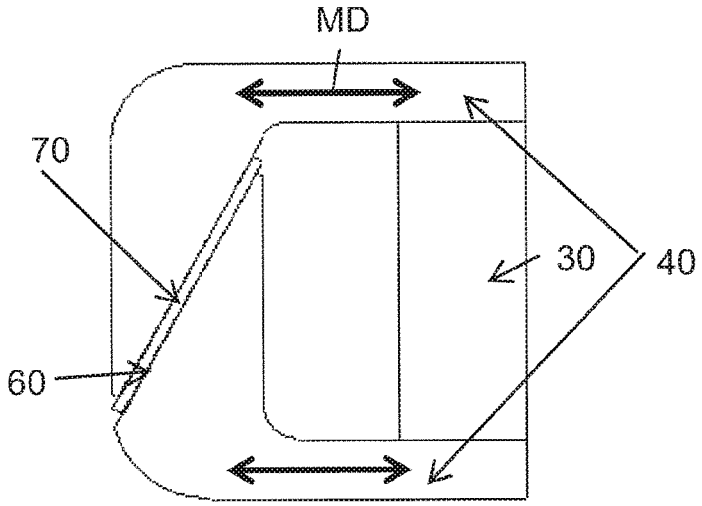
FIG. 12 is a schematic top view for illustrating an ignition coil for an internal combustion engine according to a sixth embodiment of the present invention.

FIG. 12 is a schematic top view (magnetic circuit diagram) for illustrating an ignition coil for an internal combustion engine according to a sixth embodiment of the present invention. According to the sixth embodiment, as illustrated in FIG. 12, the side core 40 is formed by a grain-oriented electrical steel sheet. The direction orthogonal to the axial direction (magnetic flux direction) of the center core 30 is set to an easy magnetization direction MD, and the gap 60 and the magnet 70 are arranged at a portion of the side core 40 that extends in the same direction as (in parallel with) the axial direction of the center core 30. Moreover, a width of portions of the side core 40 that extend in the easy magnetization direction MD is decreased. Other configurations are the same as those of the second embodiment.

In the ignition coil configured as described above, the cross-sectional area of the portion of the side core 40 that extends in the same direction as the axial direction of the center core 30 is increased in order to secure large cross-sectional areas Sg and Sm of the gap 60 and the magnet 70. Therefore, the magnetic saturation does not occur even when this direction is a direction low in the saturation magnetic flux density. Further, the saturation magnetic flux density is large in the easy magnetization direction, and the width in the easy magnetization direction can be decreased.

In the grain-oriented electrical steel sheet, a saturation magnetic flux density Bmax1 is large in the easy magnetization direction, and a saturation magnetic flux density Bmax2 is small in a direction orthogonal to the easy magnetization direction. The gap cross-sectional area and the side core cross-sectional area proportional thereto need to increase for the magnetic resistance adjustment. Thus, when the side core cross-sectional area S1 is increased, the cross-sectional area is decreased to S2 in the easy magnetization direction, the cross-sectional area of the center core 30 is denoted by Sc, and the saturation magnetic flux density is denoted by Bmax_c, $$S1>Sc>S2,$$

$$B\max 1>B\max_c>B\max 2,$$

thus $$S1*B\mathrm{mav}\approx S2*B\max''\geq Sc*B\max_c.$$

Even when S2 is decreased, the saturation of the side core 40 does not occur earlier than the saturation of the center core 30. Only the side core 40 is formed by the grain-oriented electrical steel sheet in the above-mentioned example, but the center core 30 may be formed by the grain-oriented electrical steel sheet. In this case, the center core cross-sectional area may be decreased.

As described above, according to the present invention, the sum of the cross-sectional areas of the magnets is three times or more and less than seven times of the cross-sectional area of the center core.

The energy can thus be increased without increasing the size of the center core, that is, the winding diameter of the primary coil by the magnet applying sufficient reverse bias. Moreover, the energy increases, and thus the center core can be downsized in accordance with a required performance.

The cross-sectional area of the gap is set to be equal to or larger than the cross-sectional area of the magnet.

Moreover, the gaps and the magnets are arranged in the side core.

The magnetic resistance can easily be adjusted by arranging the magnets in the side core in this way, and the magnetic characteristic can also be changed without changing the center core, the primary coil, and the secondary coil that may be used as common components.

Moreover, the height of the side core is larger than the height of the center core.

The side core width can be suppressed, that is, the increase in size of the ignition coil can be suppressed, and the magnetic resistance can be adjusted by loading the side core so as to be high in the loading thickness direction when the side core cross-sectional area is maintained.

Moreover, the cross-sectional area of the side core is larger than the cross-sectional area of the center core.

A decrease in magnetic characteristic (increase in magnetic resistance) caused by the magnetic saturation of the side core can be suppressed by setting the cross-sectional area of the side core to be larger than the cross-sectional area of the center core in this way, and the performance can thus be increased in the low magnetomotive force region.

Moreover, the cross-sectional area of the gap is larger than the cross-sectional area of the magnet.

The increase in size of the magnet can be suppressed, and the performance can be improved by setting the cross-sectional area of the gap to be larger than the cross-sectional area of the magnet, and adjusting the magnetic characteristic.

Moreover, the thickness of the gap without the magnet is decreased.

The thickness of the magnet can be a thickness that can be manufactured and assembled, and the magnetic resistance can be adjusted by changing the thickness of a part of the gap, thereby adjusting the magnetic resistance in this way without unnecessarily increasing the thickness. Thus, manufacturing defect and assembly defect of the magnet and the increase in size can be suppressed.

Moreover, the thickness of the gap is increased at the portion on the outer side of the ignition coil.

The shortcut loop across the gap (without crossing the center core) of the magnetic flux generated from the magnet can be suppressed by increasing the outer side of the gap, thereby adjusting the magnetic resistance in this way, and the inverse bias can thus be efficiently applied by the magnet.

Moreover, the thickness of the magnet is decreased as compared with the thickness of the gap, and the thickness of the gap is secured by the core cushion.

The gap thickness can be set using the core cover to secure the gap thickness in this way without unnecessarily increasing the thickness of the magnet and the number of components, and hence the magnetic resistance can be adjusted while an unnecessary increase in cost can be avoided.

Moreover, the grain-oriented electrical steel sheet is used for the side core, and the easy magnetization direction of the side core is the direction perpendicular to the axial direction of the center core.

The side core width in the easy magnetization direction can be suppressed (decreased) using the grain-oriented electrical steel sheet for the side core, and setting the easy magnetization direction of the side core to be the direction perpendicular to the axial direction of the center core in this way. The cross-sectional area is increased so as to secure the large gap in the direction parallel with the axial direction of the center core, and hence the magnetic saturation does not occur even when the direction is the direction low in the saturation magnetic flux density. As a result, the dimension in the axial direction of the center core of the ignition coil can be decreased.

The present invention is not limited to the respective embodiments, and the present invention includes all possible combinations of the respective embodiments.

INDUSTRIAL APPLICABILITY

The ignition coil for an internal combustion engine according to the present invention can be applied to internal combustion engines used in various fields.

The invention claimed is:

1. An ignition coil for an internal combustion engine, the ignition coil comprising:

a center core arranged on an inner side of a primary coil and an inner side of a secondary coil;

a side core arranged on an outer side of the primary coil and an outer side of the secondary coil, and combined with the center core to form a closed magnetic circuit;

one or a plurality of gaps provided between the center core and the side core, or in the side core; and a magnet arranged in each of the gaps, wherein a sum of sizes of cross-sectional areas of the respective magnets is set to be greater than or equal to a lower limit and less than an upper limit of a size of a cross-sectional area of a portion of the center core around which the primary coil is wound, and wherein the lower limit is three times the size of the cross-sectional area of the portion of the center core and the upper limit is seven times the size of the cross-sectional area of the portion of the center core.

2. The ignition coil for an internal combustion engine according to claim 1, wherein the side core has a cross-sectional area larger than the cross-sectional area of the portion of the center core.

3. The ignition coil for an internal combustion engine according to claim 1, wherein each of the one or a plurality of gaps has a cross-sectional area larger than the cross-sectional area of the magnet.

4. The ignition coil for an internal combustion engine according to claim 1, wherein a thickness of each of the one or a plurality of gaps is increased at another portion on an outer side of the ignition coil.

5. The ignition coil for an internal combustion engine according to claim 1, wherein a thickness of the magnet is less than a thickness of each of the one or a plurality of gaps, and wherein the thickness of each of the one or a plurality of gaps is secured by a core cushion.

6. The ignition coil for an internal combustion engine according to claim 1, wherein each of the one or a plurality of gaps has a cross-sectional area equal to or larger than the cross-sectional area of the magnet.

7. The ignition coil for an internal combustion engine according to claim 6, wherein the side core has a cross-sectional area larger than the cross-sectional area of the center core.

8. The ignition coil for an internal combustion engine according to claim 6, wherein the one or a plurality of gaps and the magnet are arranged in the side core.

9. The ignition coil for an internal combustion engine according to claim 8, wherein the side core has a height larger than a height of the center core.

10. The ignition coil for an internal combustion engine according to claim 9, wherein the side core has a cross-sectional area larger than the cross-sectional area of the center core.

11. The ignition coil for an internal combustion engine according to claim 8, wherein the side core is formed using a grain-oriented electrical steel sheet, and wherein the side core has a magnetization direction perpendicular to an axial direction of the center core.

12. The ignition coil for an internal combustion engine according to claim 8, wherein the side core has a cross-sectional area larger than the cross-sectional area of the center core.

13. The ignition coil for an internal combustion engine according to claim 1, wherein the one or a plurality of gaps and the magnet are arranged in the side core.

14. The ignition coil for an internal combustion engine according to claim 13, wherein the side core has a cross-sectional area larger than the cross-sectional area of the center core.

15. The ignition coil for an internal combustion engine according to claim 13, wherein the side core is formed using a grain-oriented electrical steel sheet, and wherein the side core has a magnetization direction perpendicular to an axial direction of the center core.

16. The ignition coil for an internal combustion engine according to claim 13, wherein the side core has a height larger than a height of the center core.

17. The ignition coil for an internal combustion engine according to claim 16, wherein the side core has a cross-sectional area larger than the cross-sectional area of the center core.

18. An ignition coil for an internal combustion engine, the ignition coil comprising:

a center core arranged on an inner side of a primary coil and an inner side of a secondary coil;

a side core arranged on an outer side of the primary coil and an outer side of the secondary coil, and combined with the center core to form a closed magnetic circuit;

a gap provided between the center core and the side core, or in the side core; and a magnet inserted in the gap, wherein a size of a cross-sectional area of the magnet is set to be equal to, or more than, three times a size of a cross-sectional area of a portion of the center core around which the primary coil is wound.

* * * * *